US007788810B2

(12) United States Patent
Noble

(10) Patent No.: US 7,788,810 B2
(45) Date of Patent: Sep. 7, 2010

(54) SHAVING SYSTEM HAVING AN UMBILICAL

(75) Inventor: David Noble, Wallingford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 624 days.

(21) Appl. No.: 11/492,615

(22) Filed: Jul. 24, 2006

(65) Prior Publication Data

US 2008/0016692 A1 Jan. 24, 2008

(51) Int. Cl.
*B26B 21/44* (2006.01)

(52) U.S. Cl. ..... 30/41.5; 30/41; 30/537

(58) Field of Classification Search ..... 30/41, 30/41.5, 537, 538
See application file for complete search history.

(56) References Cited

U.S. PATENT DOCUMENTS

| | | | | |
|---|---|---|---|---|
| 2,336,806 | A | 12/1943 | Hans et al. | |
| 4,177,556 | A | 12/1979 | Galli, Jr. | |
| 4,205,441 | A | 6/1980 | Turner | |
| 4,228,586 | A | 10/1980 | Thierry | |
| 4,370,807 | A | 2/1983 | O'Neill | |
| 4,633,585 | A | 1/1987 | Whitaker et al. | |
| 4,733,468 | A | 3/1988 | Zadro | |
| 5,058,271 | A | 10/1991 | Jursich et al. | |
| 5,177,870 | A | 1/1993 | Jursich et al. | |
| 5,673,485 | A | 10/1997 | Hill | |
| 6,131,288 | A * | 10/2000 | Westerhof et al. | 30/41 |
| 6,206,238 | B1 * | 3/2001 | Ophardt | 222/1 |
| 6,886,254 | B1 | 5/2005 | Pennella | |
| 6,913,606 | B2 | 7/2005 | Saitou et al. | |
| 6,964,097 | B2 | 11/2005 | Franzini et al. | |
| 7,007,390 | B2 | 3/2006 | Mislove | |
| 7,043,843 | B2 | 5/2006 | Krupka et al. | |
| 7,234,239 | B2 * | 6/2007 | Saito et al. | 30/41 |
| 7,441,336 | B2 * | 10/2008 | Hawes et al. | 30/45 |
| 2005/0120560 | A1 | 6/2005 | Franzini et al. | |
| 2005/0123342 | A1 | 6/2005 | Bressler et al. | |
| 2005/0138814 | A1 | 6/2005 | Pennella et al. | |
| 2005/0144785 | A1 | 7/2005 | Bressler et al. | |
| 2006/0032053 | A1 | 2/2006 | Saker et al. | |

(Continued)

FOREIGN PATENT DOCUMENTS

| | | |
|---|---|---|
| GB | 2351779 | 10/2001 |

(Continued)

OTHER PUBLICATIONS

International Search Report and Written Opinion for PCT/US2007/016602, dated Dec. 20, 2007.

(Continued)

*Primary Examiner*—Hwei-Siu C Payer
(74) *Attorney, Agent, or Firm*—Energizer Personal Care, LLC

(57) ABSTRACT

A shaving system includes a safety razor and a base station spaced apart from one another. The base station has a reservoir adapted to contain a shaving aid material capable of fluid flow. The base station is linked to the safety razor by an umbilical to provide fluid communication between the reservoir and an applicator of the safety razor to deliver the shaving aid material to the skin surface of a user during a shaving operation. A pump can be provided to propel the shaving aid material. A sensor can be provided to initiate operation of the pump. The reservoir can be refillable or replaceable.

13 Claims, 8 Drawing Sheets

U.S. PATENT DOCUMENTS

| | | | |
|---|---|---|---|
| 2006/0032054 | A1 | 2/2006 | Simms et al. |
| 2006/0032055 | A1 | 2/2006 | Simms et al. |

FOREIGN PATENT DOCUMENTS

| | | |
|---|---|---|
| GB | 2 417 007 | 2/2006 |
| WO | WO 00/47374 | 8/2000 |

OTHER PUBLICATIONS

Written Opinion of the International Searching Authority dated Feb. 5, 2009 regarding International Application No. PCT/US2007/016602.

* cited by examiner

SHAVING SYSTEM HAVING AN UMBILICAL

BACKGROUND

1. Technical Field

This invention relates generally to wet shaving devices, and more specifically to shaving systems having a safety razor in fluid communication with a base station having a reservoir, the base station being spaced apart from the safety razor.

2. Background Information

Many modern shaving implements, commonly known as wet shave or safety razors, include a disposable razor cartridge, releasably connected to a reusable handle. Other modern safety razors have a handle and a razor cartridge that are intended to be permanently coupled and disposed of as a single unit. The cartridge comprises a housing having at least one razor blade with a sharpened cutting edge disposed therein. The cutting edge can be rectilinear or the razor blade can comprise a foil having a plurality of apertures having cutting edges extending at least partially around perimeter thereof.

There have been many proposals to provide a safety razor with a dispensing system for delivering to the skin during shaving a shaving aid material, such as shave foam, shave cream or other lubricating fluid, or skin care materials that cleanse or otherwise care for the skin. The material is stored within a reservoir ready for use. The stored material can replace a customary shaving preparation or can be used in addition thereto. According to many of these prior proposals the reservoir is accommodated within the razor handle or clipped or otherwise attached to the outside of the handle. For many typical wet shaves (for a male user) it is desirous for about 12 ml or more of some particular shaving aid materials to be dispensed for each shave. If the shaving aid material is aqueous based it can have a Specific Gravity of about 1.0 thus for each shave about 12 g or more of shaving aid material is required. Thus to satisfy just one shave a reservoir should contain at least about 12 ml or 12 g of shaving aid material. It would be convenient for the shaver not to have to replace or refill a reservoir for every single shave and it would be more convenient for the reservoir to contain sufficient shaving aid material to satisfy several shaves. By simple arithmetic, for the reservoir to contain sufficient shaving aid material for 10 shaves it must contain at least about 120 ml or 120 g of shaving aid material. A satisfactory mass for a reusable razor handle can be about 20-40 g and this handle might occupy a volume of about 10-30 ml. A disposable razor can have a satisfactory mass of about 5-15 g and occupy a volume similar to a reusable razor handle. The reader of the present application will quickly understand that a reservoir, conveniently sized to provide shaving aid material for 10 shaves, is many times too large to be housed within a reusable razor handle. Furthermore, a reservoir attached externally to a disposable or reusable handle will be many times larger and heavier than the handle to which it is attached and the razor can become highly unwieldy in use.

Based on the foregoing, it is desirous to provide a shaving system having a wet shave or safety razor in fluid communication with a base station, spaced apart from the razor, by an umbilical. The razor will not be unwieldy in use. The base station includes a reservoir of shaving aid material that can be sized to accommodate sufficient shaving aid material to satisfy several shaves.

SUMMARY

The shaving system of the present invention comprises a base station having a reservoir for holding a shaving aid material and a safety razor having a handle and a razor cartridge. The safety razor includes an applicator for depositing the shaving aid material on the skin of a user during the act of shaving. The base station and safety razor are spaced apart and are interconnected by an umbilical to provide fluid communication between the reservoir and the applicator. The reservoir can be refillable by the user or can disposable and can be replaced when wholly or partially exhausted.

In one embodiment of the present invention a pump is provided. The pump can be in the base station to propel the shaving aid material from the reservoir. The pump can alternatively be in the handle or can be in the umbilical. In further aspects of the present embodiment a sensor is provided to initiate operation of the pump. The sensor can sense a definite and specific physical action by the user, such a sensor can be an "on" or "on/off" switch or push-button. The sensor can alternatively be a moisture sensor, proximity sensor, motion sensor or other suitable sensor which each sense when the razor is in use or about to be used. The sensor can be situated in the razor handle, in the base station or remotely from both.

In another embodiment of the present invention the shaving aid material in the reservoir is pressurized. The pressure can cause the shaving aid material to flow to the applicator, via the umbilical, when a valve is opened. The valve can be manually operated by the user or can be electrically operated.

In a further aspect, the present invention comprises a base station for a shaving system. The base station is adapted for connection to the first end of an umbilical, the second end being connected to a safety razor having an applicator. The base station has a reservoir for holding a shaving aid material capable of fluid flow. The reservoir can be refillable by the user or can disposable and can be replaced when partially or wholly exhausted. The base station can include a pump adapted to cause the shaving aid material to flow from the reservoir. The base station can further include a sensor adapted to initiate operation of the pump and a controller adapted to control the flow rate of the shaving aid material. The controller can be manually adjustable by the user or can be electronic and control the operation of the pump in response to a signal from the sensor.

In a yet further aspect, the present invention comprises a disposable reservoir for a shaving system as previously described. The reservoir contains a shaving aid material capable of fluid flow. The reservoir is adapted for selective connection to a base station of the shaving system. The reservoir can include a rigid portion or can be a flexible pouch.

Embodiments of the invention can include one or more of the following advantages. The safety razor is adapted to dispense a shaving aid material onto the skin of a user during the act of shaving to provide excellent shaving characteristics. The safety razor is not unduly voluminous or weighty and will not be unwieldy in use. The reservoir contains a sufficiently large quantity of shaving aid material that it will only need to be refilled or replaced periodically.

The above features and advantages of the present invention will be more fully understood with reference to the following detailed description when taken in conjunction with the accompanying drawings.

DETAILED DESCRIPTION

Figure 1:
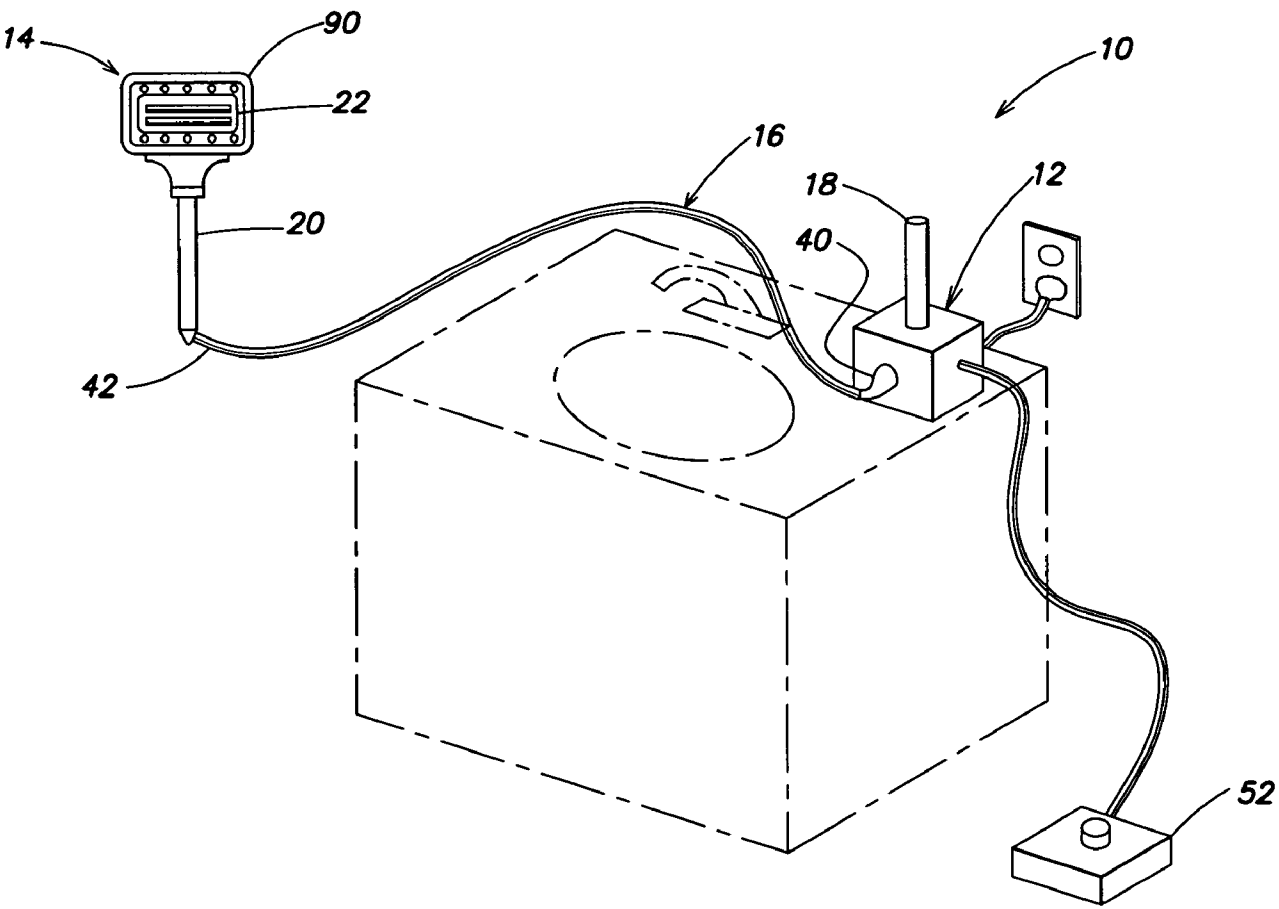
FIG. 1 is an isometric view of an embodiment of the shaving system of the present invention.

Referring now to the drawings and in particular FIG. 1, a shaving system 10 is shown comprising a base station 12 and a safety razor 14. The base station includes a reservoir 18 adapted to contain a shaving aid material capable of fluid flow. The safety razor comprises a handle 20, a razor cartridge 22 and an applicator 90. An umbilical 16 is connected at its first end 40 to the base station and at its second end 42 to the safety razor so that fluid communication is provided from the reservoir to the applicator in order that shaving aid material can be deposited on the skin surface of a user (not identified in this figure, see FIGS. 4 & 5) during a shaving operation.

The shaving aid material is preferably a liquid or any other material capable of fluid flow such as a cream or gel, etc. A wide variety of shaving aid materials can be applied to the skin during shaving using a shaving system in accordance with the present invention, including materials exhibiting the properties or qualities or any one or more of the following: (i) shaving soap; (ii) lubricant; (iii) skin conditioner; (iv) skin moisturizer; (v) hair softener or conditioner to facilitate cutting; (vi) fragrance; (vii) skin cleanser; (viii) bacterial or medicinal lotion; (ix) depilatory agent; and (x) blood coagulant or the like for beneficial treatment of minor cuts and abrasions which can be suffered during shaving. While certain shaving aid materials have been described, the present invention is not limited in this regard as materials known to those skilled in the art to which the present invention pertains can be substituted without departing from the broader aspects of the present invention.

Figure 4:
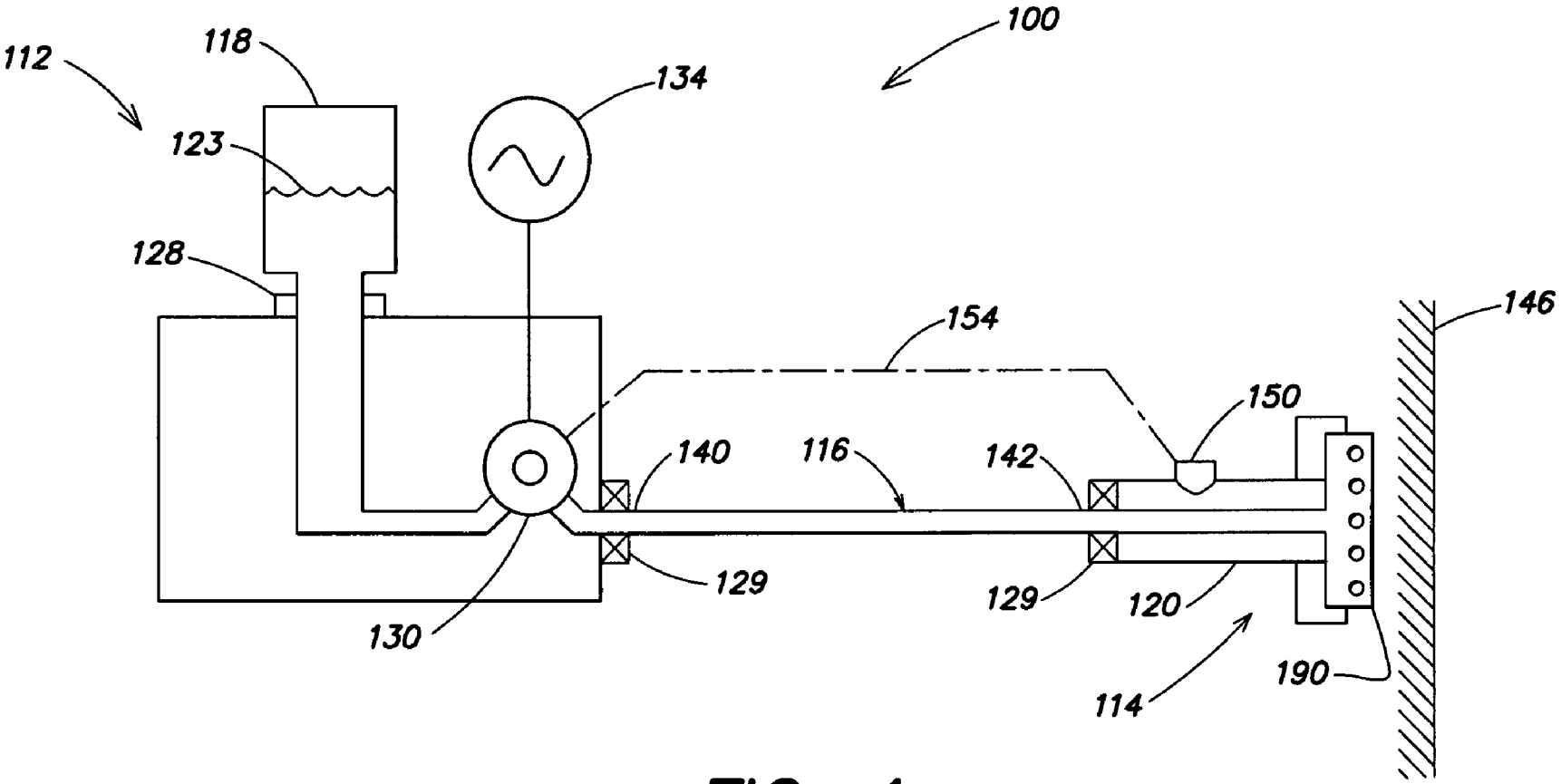
FIG. 4 is a schematic circuit diagram of an embodiment of the shaving system of the present invention
Figure 5:
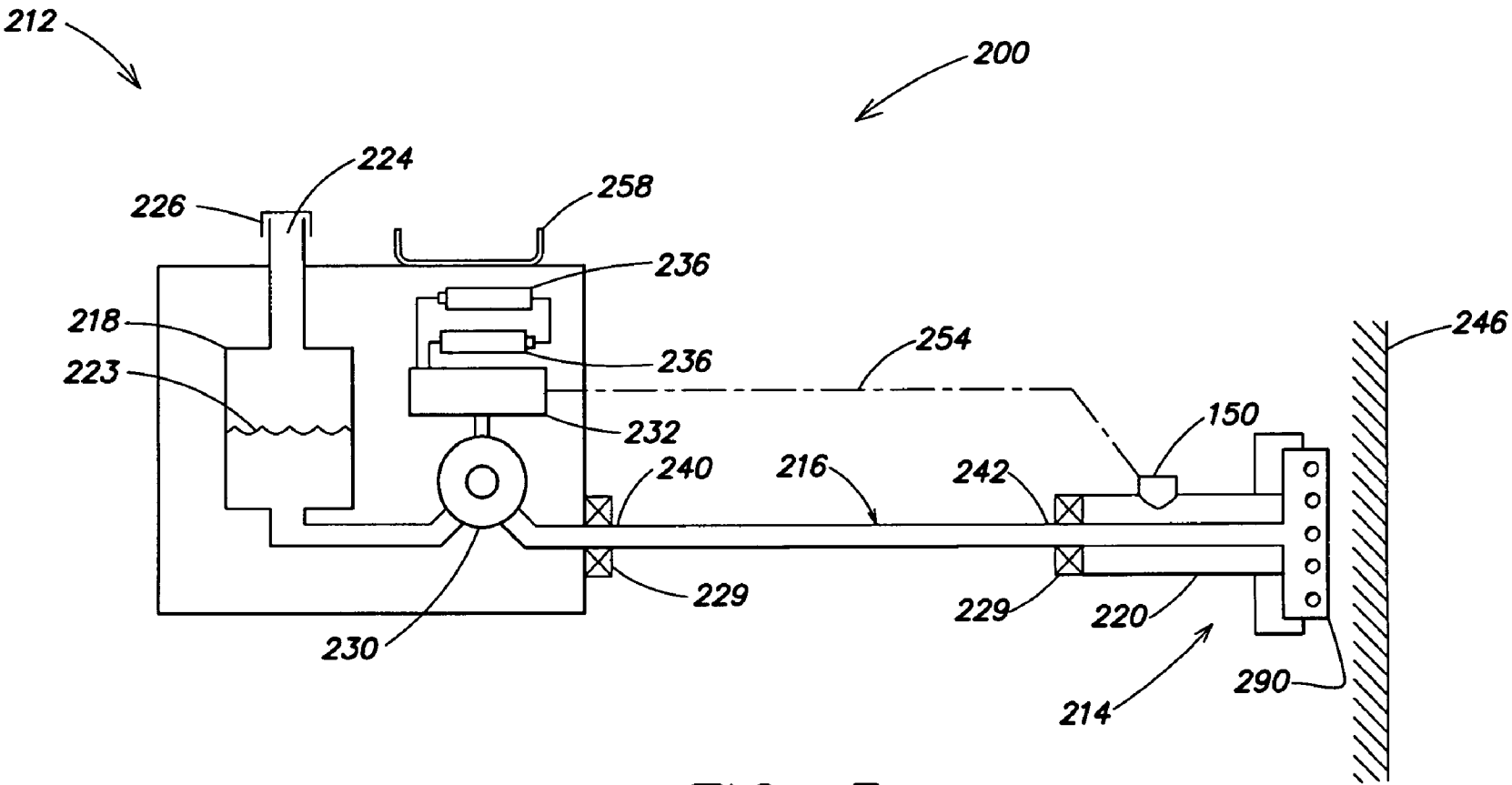
FIG. 5 is a schematic circuit diagram of another embodiment of the shaving system of the present invention
Figure 7:
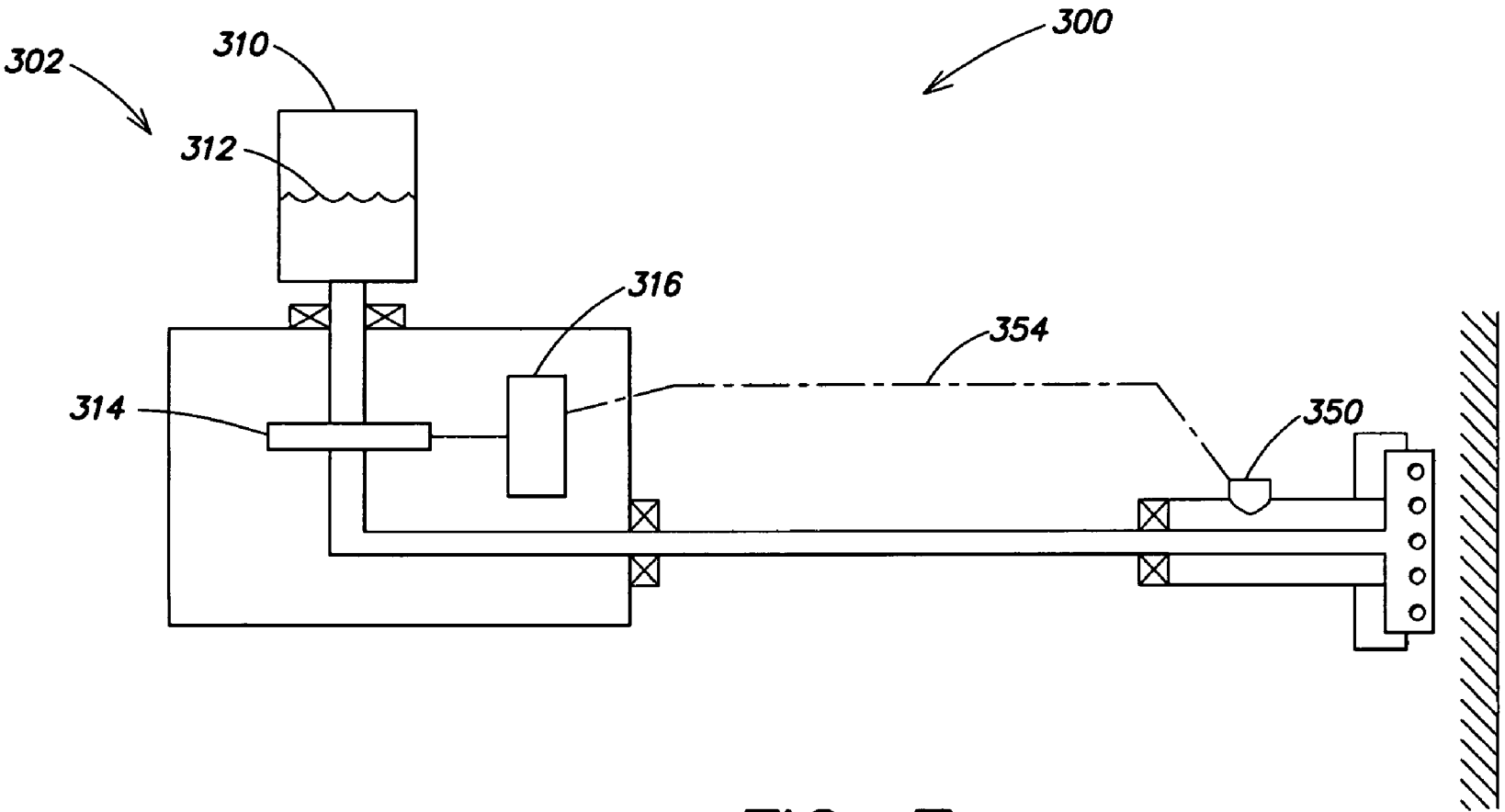
FIG. 7 is a schematic circuit diagram of a further embodiment of the shaving system of the present invention
Figure 7A:
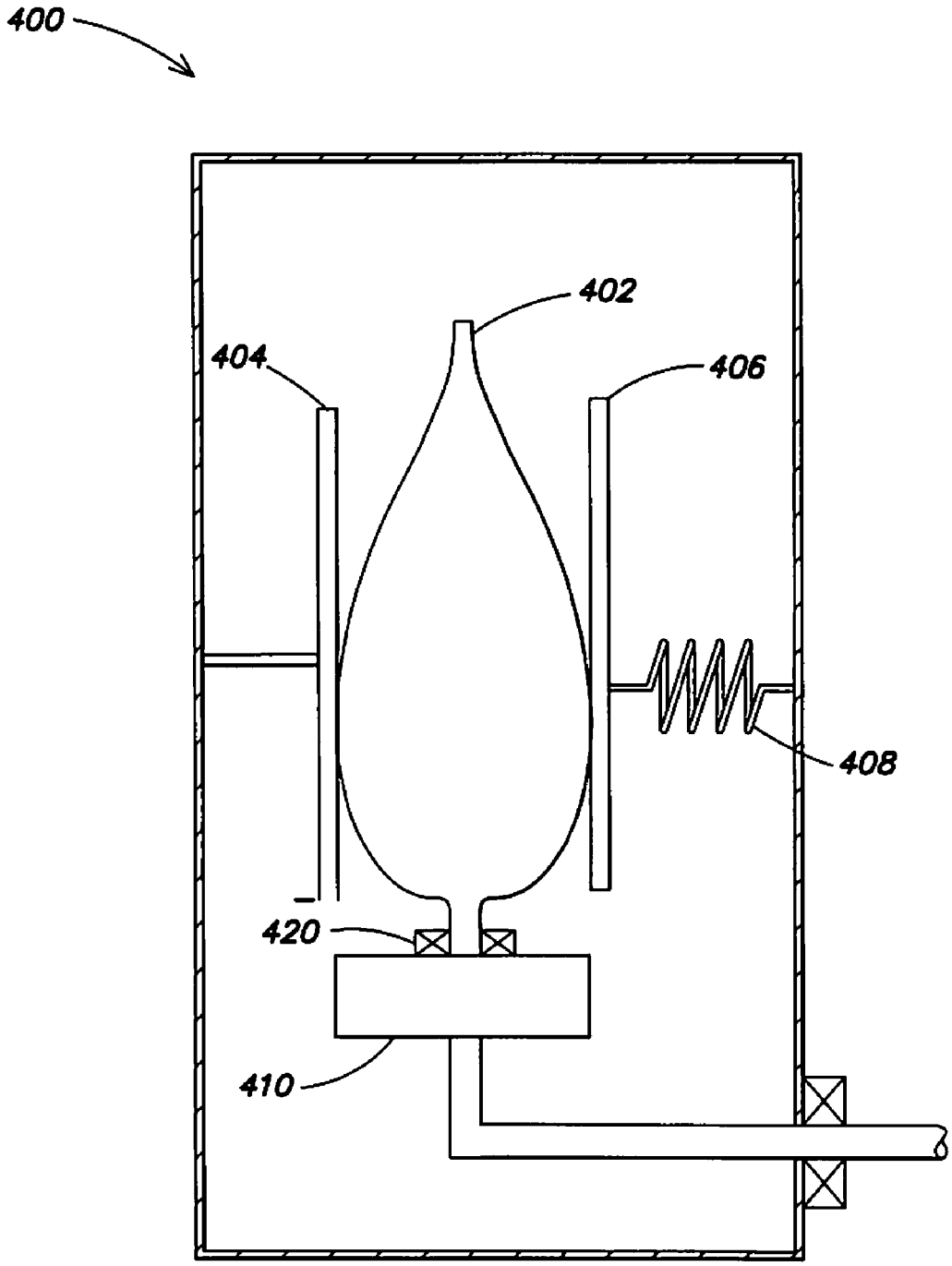
FIG. 7A is a schematic circuit diagram of a further embodiment of a base station of the present invention

Referring additionally now to FIGS. 4-5, schematic circuit diagrams of exemplary embodiments of the shaving system 100, 200 respectively are depicted. Elements shown in these figures, and in FIGS. 7 and 7A are schematic representations thereof only. The base station 112, 212 has a reservoir 118, 218 preferably wholly disposed within the base station, but this can equally be disposed partially within the base station or externally thereto. The reservoir contains a shaving aid material 123, 223. FIG. 5 depicts a reservoir that is refillable through an opening 224 having a selectively removable closure or filler cap 226. The filler cap 226 is preferably retained by a bayonet-type coupling but can be a push-in cap (for instance a cork or bung), push-on cap, screwed coupling or snap-fit coupling. FIG. 4 depicts a preferred embodiment wherein the reservoir 118 is adapted to be selectively replaced by the user when wholly or partially exhausted. The reservoir is preferably rigid, for instance a bottle or canister, or can comprise a flexible portion, for instance a collapsible flexible pouch. The reservoir is coupled to the base station by a coupling 128 that is preferably a bayonet-type coupling wherein a part of the connector couple is included with the reservoir and the mating part of the connector couple is included with the base station. The connection can also be a screwed type coupling or a push-in type coupling. The shaving system has a pump 130, 230, preferably located wholly or partially within the base station. In other embodiments the pump may be in the razor handle or in the umbilical. The pump is preferably a positive displacement pump and most preferably a peristaltic pump but can also be a piston pump, a diaphragm pump, a piezo pump or other pump type well known to one of skill in the art. The present invention is not limited in regard to the location or type of pump. The pump is preferably powered by electricity which is most preferably conventional domestic AC 134 or can be powered by at least one battery 236. The battery or batteries can be rechargeable or non-rechargeable. The pump can also be mechanically powered, for example by clockwork or other well known spring powered mechanisms and the present invention is not limited in this regard. The umbilical 116, 216 is connected at its first end 140, 240 to the base station and at its second end 142, 242 to a safety razor 114, 214 having an applicator 190, 290 adapted to deposit the shaving aid material on the skin of a user 146, 246 during the act of shaving. The connection of the umbilical 116, 216 to one or both of the pump and applicator is preferably by a selectively removable coupling 129, 229 having mating couple parts as previously described that can be a bayonet, screwed or push-type connector. In this way the umbilical can be disconnected for periodic cleaning by the user. The connection of the umbilical to one or both of the base station and safety razor can also be permanent.

Figure 6:
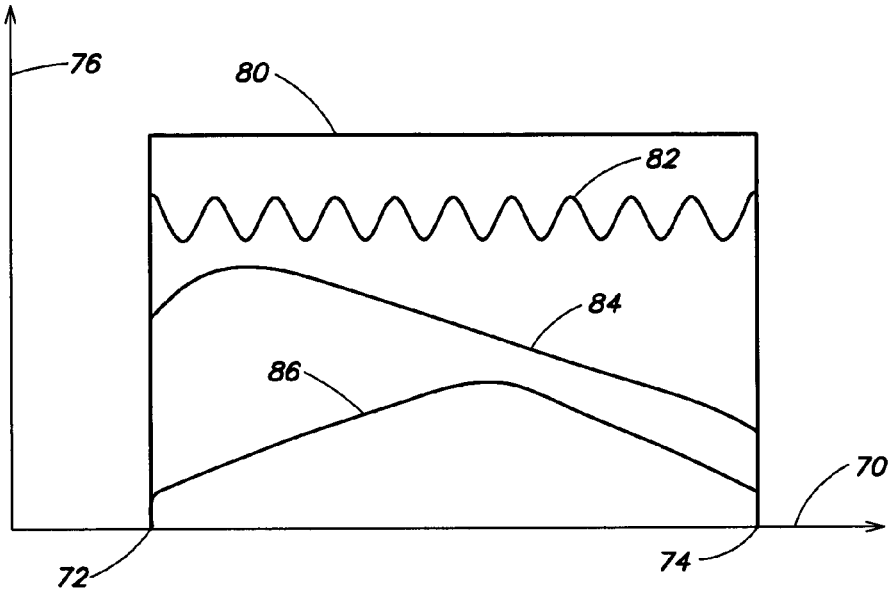
FIG. 6 is a graphical representation of the flow rate of several embodiments of the shaving system of the present invention

A sensor 150, 250 is provided that is preferably disposed wholly or partially with the handle 120, 220 of the safety razor. Activation of the sensor by any means described herein initiates operation of the pump to cause the shaving aid material to flow to the applicator. In a preferred embodiment the sensor is an "on" or "on/off" switch or push-button that simply senses a definite and specific physical action by the user. A switch or push-button 530 (not identified in these Figs, see FIG. 2) can also be disposed in the base station or remotely therefrom, for instance a foot operated switch 52 as shown in FIG. 1. The sensor is in communication with the pump through a communication circuit 154, 254. The communication is preferably electrical but can also be non-electric, for instance infra-red or laser light, radio frequency or ultrasonic sound. The sensor 150, 250 can also be automatic in that it does not require a specific physical action by the user. The sensor can be a moisture sensor that initiates flow of the shaving aid material when the safety razor comes into contact with water. A typical moisture sensor is described in US Patent Application publication 2006/0032053 where it is used to initiate a vibration mechanism, essential subject matter of which is incorporated herein for reference. The sensor can also be a proximity sensor that initiates flow when the safety razor is brought into close proximity to the skin of the user. A typical proximity sensor is described in US Patent Application publication 2006/0032055 where it is used to initiate a vibration mechanism, essential subject matter of which is incorporated herein for reference. The sensor can further be a Hall effect sensor or magnetic switch or tilt switch that initiates flow when the safety razor is removed from a storage tray. A typical magnet switch is described in US Patent Application publication 2006/0032054 where it is used to initiate a vibration mechanism, essential subject matter of which is incorporated herein for reference. The storage tray is preferably integral with the base station but the present invention is not limited in this regard. The sensor can further be a motion sensor or accelerometer that initiates flow when the safety razor is not stationary and in use. Termination of flow of the shaving aid material can be accomplished by negation of any sensor signal, as described above. In other embodiments of the present invention, a controller 232 may be provided in the communication circuit between the sensor and the pump and termination of flow can be achieved by the controller, for example after a predetermined time. GB Patent application 2,417,007, essential subject matter of which is incorporated herein for reference, discloses a safety razor having a fluid delivery system. The fluid delivery system includes a control device for actuating a pump and deactivating the pump after a certain time of actuation, e.g. 0.1 to 2 seconds. The controller can also adjust the operation of the pump to vary the flow rate of the shaving aid material. Referring additionally now to FIG. 6, this depicts graphical representations of several embodiments of the flow rate of the shaving aid material. The horizontal 70 axis represents time and identifies the initiation 72 and termination 74 of flow. The vertical axis 76 represents flow rate but is shown dimensionless so that the flow curves can be separated from each other for ease of understanding, rather than confusingly superimposed on one another. A preferred flow rate 80 has a constant flow rate between initiation and termination. Alternate flow rates shown are a pulsed flow 82; an attenuating flow 84; a peak flow 86 or the flow rate can be any combination thereof.

Figure 3B:
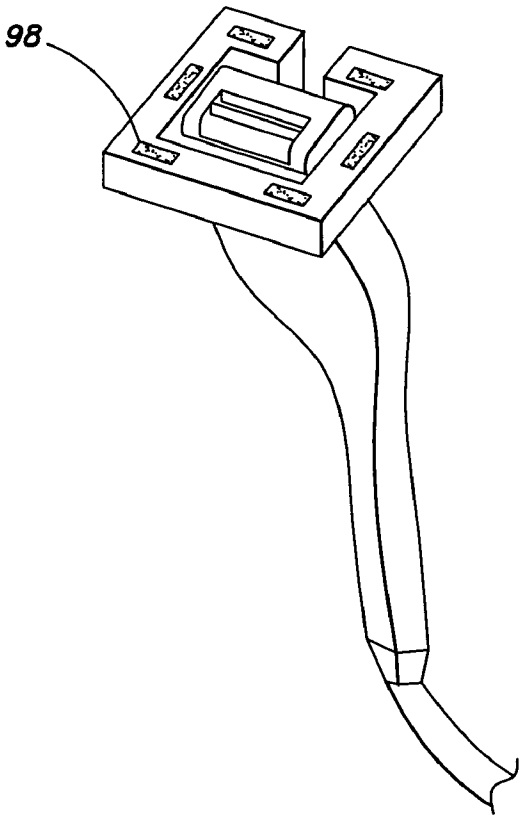
FIG. 3B is an isometric view of a further embodiment of a safety razor of the present invention
Figure 3A:
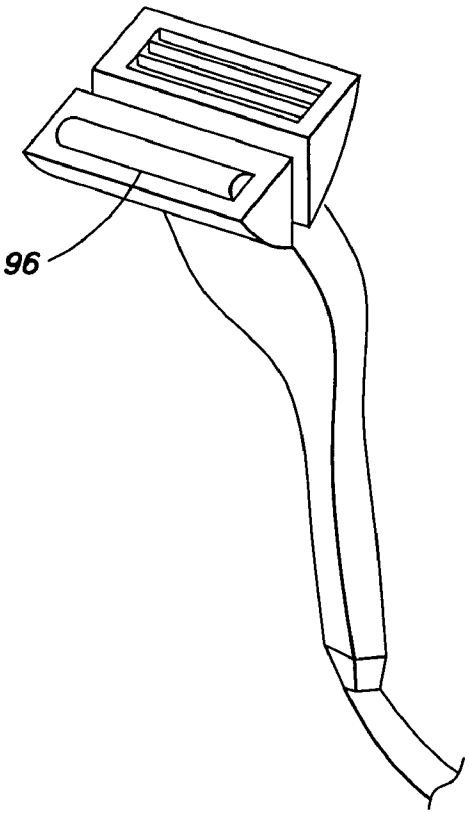
FIG. 3A is an isometric view of another embodiment of a safety razor of the present invention
Figure 3:
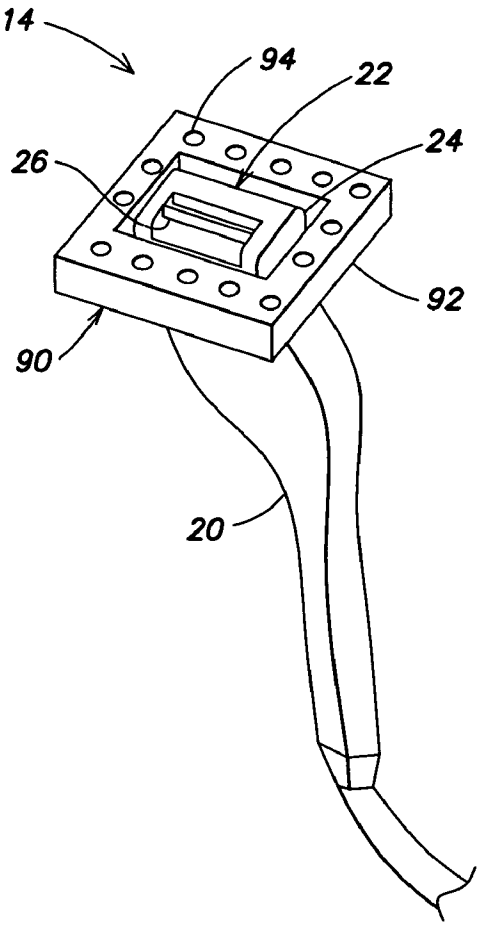
FIG. 3 is an isometric view of an embodiment of a safety razor of the present invention

Referring additionally now to FIGS. 3, 3A and 3B the safety razor 14 comprises a handle 20 and a razor cartridge 22. The razor cartridge has a housing 24 and at least one razor blade 26. The safety razor has an applicator 90. FIG. 3 depicts a preferred applicator that comprises a manifold 92 that is adjacent to the razor cartridge and completely or partially surrounds the razor cartridge. The manifold is preferably provided with one or more ports 94 to permit flow of the shaving aid material onto the skin of the user. As depicted in FIG. 3A, the applicator can alternatively comprise one or more rollers 96 adapted to deposit the shaving aid material on the skin of the user. A description of a typical roller applicator is disclosed in US Patent Application publication 2005/0138814, essential subject matter of which is incorporated herein for reference. As depicted in FIG. 3B, the applicator can further alternatively comprise one or more portions of porous material 98 adapted to deposit the shaving aid material on the skin of the user. A description of a typical porous material applicator is disclosed in U.S. Pat. No. 6,886,254 to Pennella, essential subject matter of which is incorporated herein for reference.

Referring now to FIG. 7, a schematic circuit diagram of another embodiment of the shaving system 300 is depicted. The shaving system comprises a base station 302. The base station comprises a reservoir 310 containing a pressurized shaving aid material 312. The pressurization can be internal to the reservoir, such as can be provided by propellant in a typical aerosol. Flow of the material from the reservoir is controlled by a valve 314, preferably a solenoid valve. The solenoid valve can be in control communication 354 with a sensor 350 via a controller 316 as previously described. Control communication can be electrical or non-electrical as previously described. Alternatively the communication circuit can be omitted and the valve can be a user actuated valve, such as a tap, ball valve, pinch valve, roller valve or gate valve. In some instances the valve can also control flow rate of the shaving aid material in addition to providing initiation and termination of flow of the shaving aid material. Typical valves are described in published applications for US Patents 2005/0138814 and 2005/0120560 essential matter of which is incorporated herein by reference. In this embodiment the reservoir 310 is preferably replaceable as the shaving aid material can be under pressure. Referring now to FIG. 7A, a schematic circuit diagram of a further embodiment of the base station 400 of a shaving system of the present invention is depicted. In this embodiment the pressurization is provided by means external to the reservoir, such as can be provided by squeezing or other mechanical manipulation of the reservoir. The reservoir can comprise a flexible portion. Typical reservoirs having flexible portions and manipulating means are described in U.S. Pat. No. 6,913,606 to Saitou et al and U.S. Pat. No. 6,964,097 to Franzini et al and in US Patent application publication 2005/0144785 essential matter of the aforementioned publications is incorporated herein by reference. The reservoir can also comprise a generally cylindrical rigid portion and have a movable piston disposed within it, where movement of the piston causes the shaving aid material contained within the reservoir to be expelled. A rigid cylinder and piston arrangement having a spring driven piston is described in US Patent application publication 2005/0123342, essential matter of which is incorporated herein by reference. In the embodiment depicted in FIG. 7A, a reservoir 402 having a flexible portion is situated between a first and second anvil 404, 406 respectively. At least one anvil is movable under the force from a spring 408 that causes the reservoir to be squeezed between the two anvils, causing the shaving aid material stored within the reservoir to be pressurized. Flow of the shaving aid material is controlled by a valve 410, as previously described. The reservoir is selectively attached to the base station by a coupling 420 as previously described.

Figure 2:
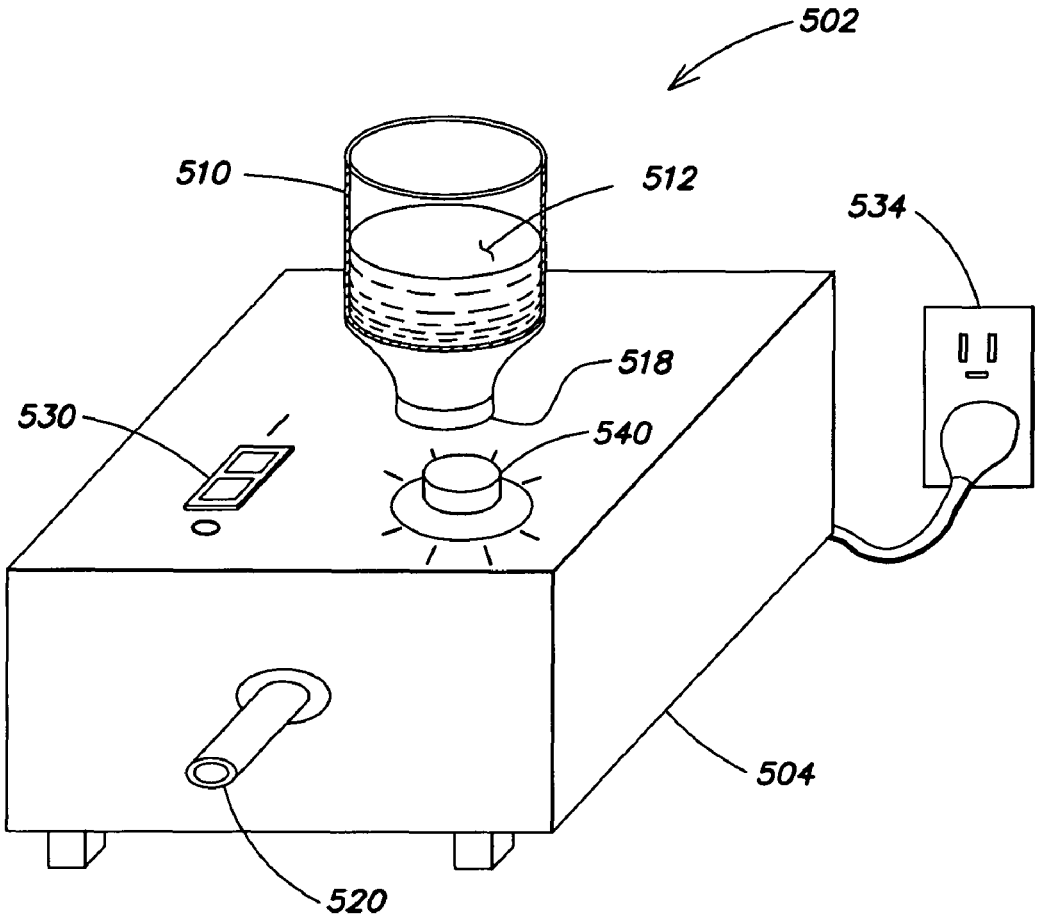
FIG. 2 is an isometric view of an embodiment of a base station of the present invention.

Referring now to FIG. 2, a base station 502 of another aspect of the present invention is depicted. The base station comprises a housing 504. The base station has a part of a first connector couple 518, as previously described, wherein a reservoir 510 having a mating connector couple part can be selectively attached. A part of a second connector couple 520 is provided wherein the first end of an umbilical having a mating connector couple part, as previously described, can be selectively attached thereto to provide fluid communication from the base station to a safety razor having an applicator, as also previously described, selectively attached to the second end of the umbilical. The reservoir 510 contains a shaving aid material 512. The base station can have an "on/off" switch 530 that initiates and terminates operation of a pump housed within the base station. The base station is in electrical communication with a conventional domestic AC outlet 534 that provides power for the pump. The pump can also be battery powered or mechanically powered as previously described. The base station can further include a user adjustable flow rate controller 540.

Figure 8:
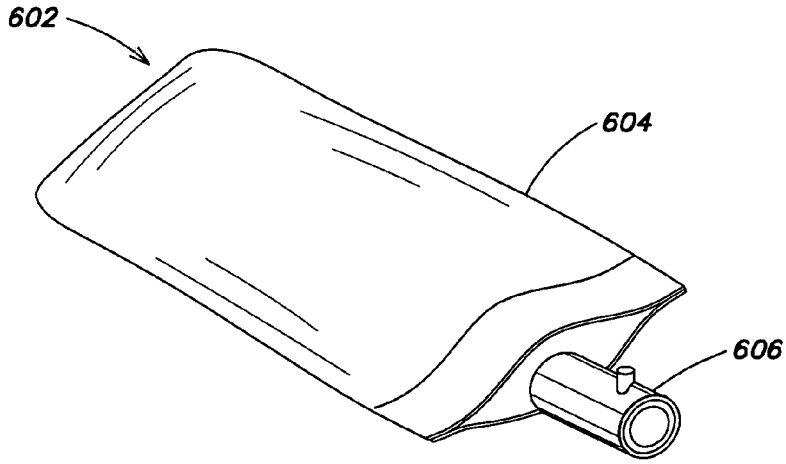
FIG. 8 is an isometric view of an embodiment of a replacement reservoir for a shaving system of the present invention.

Referring now to FIG. 8, a replacement reservoir 602 of a further aspect of the present invention is depicted. The reservoir has a body portion 604 containing a shaving aid material. The reservoir preferably contains about 120 ml of shaving aid material but the present invention is not limited to the capacity of the reservoir. The body portion can be rigid or flexible as previously described. The reservoir also has one part of a connector couple 606 so that the reservoir can be selectively attached to a base station as previously described.

It is to be understood that the present invention is by no means limited to the particular construction herein disclosed and/or shown in the drawings, but also comprises any modifications or equivalents within the scope of the disclosure.

What is claimed is:

1. A shaving system, comprising:

a safety razor having a handle, a razor cartridge, a sensor and an applicator adapted to deposit a shaving aid material on a skin surface of a user during an act of shaving;

a base station having a valve and connection means for a reservoir adapted to contain a shaving aid material capable of fluid flow, and having mechanical means to pressurize the shaving aid material, the mechanical means being external to the reservoir; and an umbilical having a first end connected to the base station and a second end connected to the safety razor, the umbilical being adapted to provide fluid communication between the reservoir and the applicator, wherein the sensor is in communication with the valve by one of an infra-red, laser light, radio frequency and ultrasonic sound communication circuit;

wherein the valve is adapted to automatically initiate flow of the shaving aid material from the reservoir to the applicator; and wherein the base station is spaced apart from the safety razor.

2. The shaving system of claim 1, wherein the reservoir contains a shaving aid material capable of fluid flow.

3. The shaving system of claim 1, wherein the base station further comprises means adapted to control the flow rate of the shaving aid material.

4. The shaving system of claim 1, wherein the reservoir is selectively replaceable by the user.

5. A shaving system, comprising:

a safety razor having a handle, a razor cartridge, a sensor and an applicator adapted to deposit a shaving aid material on a skin surface of a user during an act of shaving;

a base station having a pump and a reservoir adapted to contain a shaving aid material capable of fluid flow, wherein the pump is adapted to cause shaving aid material to flow; and an umbilical having a first end connected to the base station and a second end connected to the safety razor, the umbilical being adapted to provide fluid communication between the reservoir and the applicator, wherein the sensor is in communication with the pump by one of an infra-red, laser light, radio frequency and ultrasonic sound communication circuit and is adapted to automatically initiate flow of the shaving aid material from the reservoir to the applicator; and wherein the base station is spaced apart from the safety razor.

6. The shaving system of claim 5, wherein the reservoir contains a shaving aid material capable of fluid flow.

7. The shaving system of claim 5, wherein the base station further comprises means adapted to control the flow rate of the shaving aid material.

8. A shaving system according to claim 7, wherein the reservoir is selectively refillable by the user.

9. A shaving system according to claim 7, wherein the reservoir is selectively replaceable by the user.

10. A shaving system, comprising:

a safety razor having a handle, a razor cartridge, a sensor and an applicator adapted to deposit a shaving aid material on a skin surface of a user during an act of shaving;

a base station having a reservoir, a valve, and connection means for the reservoir, wherein the reservoir is adapted to contain a pressurized shaving aid material capable of fluid flow; and an umbilical having a first end connected to the base station and a second end connected to the safety razor, the umbilical being adapted to provide fluid communication between the reservoir and the applicator, wherein the sensor is in communication with the valve by one of an infra-red, laser light, radio frequency and ultrasonic sound communication circuit;

wherein the valve is adapted to automatically initiate flow of the shaving aid material from the reservoir to the applicator; and wherein the base station is spaced apart from the safety razor.

11. The shaving system of claim 10, wherein the reservoir contains a pressurized shaving aid material capable of fluid flow and the pressure is internal to the reservoir.

12. The shaving system of claim 10, wherein the base station further comprises means adapted to control the flow rate of the shaving aid material.

13. The shaving system of claim 12, wherein the reservoir is selectively replaceable by the user.

* * * * *